US005926844A

United States Patent [19]

Bear

[11] Patent Number: 5,926,844

[45] Date of Patent: Jul. 27, 1999

[54] EXTERNAL SOCCER SHIN GUARD STRAP

[76] Inventor: Mark P. Bear, 1203 Jimson Cir. SE., Conyers, Ga. 30013

[21] Appl. No.: 08/998,534

[22] Filed: Dec. 26, 1997

[51] Int. Cl.[6] ..... A41D 13/00

[52] U.S. Cl. ..... 2/22; 2/911

[58] Field of Search ..... 2/22, 23, 311, 2/321, 920, 919, 908, 911, 240, 338; 24/72.5, 442–447

[56] References Cited

U.S. PATENT DOCUMENTS

| | | | |
|---|---|---|---|
| 3,465,364 | 9/1969 | Edelson | 2/22 |
| 4,306,315 | 12/1981 | Castiglia | 2/22 |
| 4,669,126 | 6/1987 | Jones | 2/22 |
| 5,581,817 | 12/1996 | Hicks | 2/22 |
| 5,625,896 | 5/1997 | LaBarbera et al. | 2/22 |
| 5,742,945 | 4/1998 | Lindaman | 2/22 |

*Primary Examiner*—John J. Calvert
*Assistant Examiner*—Tejash D. Patel
*Attorney, Agent, or Firm*—James B. Middleton

[57] ABSTRACT

An adjustable, resealable and reusable elastic strap worn on the outside of a soccer sock and used for locking the shin guard in its intended protective position. This external shin guard strap includes a piece of woven, braided or knitted elastic material and matched pieces of hook and loop material (e.g., Velcro®) attached at its ends. The elastic material is provided in different lengths to accommodate use at either the ankle, midpoint of the or knee position and for different sizes of the leg. The elastic material is compatible with inks, dyes or pigments for permanently labeling and/or coloring the device.

8 Claims, 3 Drawing Sheets

EXTERNAL SOCCER SHIN GUARD STRAP

BACKGROUND OF THE INVENTION

1. Field of the Invention

This invention relates generally to sports equipment and is more particularly concerned with a means for securing the position of a soccer shin guard during competitive sports activity.

2. Discussion of Prior Art

Soccer players wear shin guards to protect their lower leg from inadvertent injury during the course of soccer play. It is well known in the art to attach one or more elastic straps directly to the shin guard as a means of securing it in the proper protective position around the player's lower leg. The prior art includes a variety of patents which employ various methods to keep shin guards in place while soccer players are engaged in the sport.

Shin guards are held in position against the leg by a variety of means, including: (1) continuous or separate elastic straps affixed to the shin guard; (2) fixed, non-adjustable split loop material attached to the longitudinal surface of the shin guard which attaches to the inside surface of the soccer sock (Edelson, U.S. Pat. No. 3,465,364); (3) customized soccer socks for holding shin guards in position (Hicks, U.S. Pat. No. 5,581,817 and Jones, U.S. Pat. No. 4,669,126); and (4) strapless shin guards held in place simply by the tension created by the knit soccer sock.

Despite the prior art of attached elastic shin guard straps, custom molded shin guards (Jacobs, U.S. Pat. No. 5,405,312) and customized socks, a soccer shin guard is prone to movement to an uncomfortable, interfering or non-protective position. The use of athletic tape, wrapped around the sock immediately below or above the shin guard, has solved the problem of shin guard movement for many players. However, the use of athletic tape for this application is associated with many problems, including: (1) time consuming attachment and removal; (2) detachment of tape and loss of the locking seal when wet; (3) breakage of tape during play and loss of the locking seal; (4) not-reusable; and (5) adhesive-induced fraying and destruction of the knit soccer sock. Furthermore, discarded athletic tape litters soccer fields and complexes, and can damage lawn equipment used to maintain the fields.

SUMMARY OF THE INVENTION

The objective of this invention is to provide an external means of locking shin guards in their intended protective position, like tape, but without tape's disadvantages. The advantages of this invention include: (1) quick and easy attachment and removal, (2) reusable, (3) non-littering, (4) adjustable fit, (5) non-breakable, (6) detachment resistance to water, and (7) non-destructive to soccer socks. Another objective of the invention is to provide a compatible surface for coloring or labeling the external shin guard strap with water proof inks and/or dyes.

The objectives of this invention are realized by fabricating an elastic strap, made of either woven, knitted or braided elastic, or similar materials, with a matching pair of hook material and loop material (e.g., Velcro®), or a matching pair of snaps or similar mechanism, attached at the ends of the elastic strap. The elastic strap will have a minimum 80% stretch of its original length and have sufficient elasticity to provide a secure and comfortable fit for its intended use. The elasticity should not be too great as to prohibit easy use of the device. The elastic strap may be cut into different lengths to accommodate its use at either the ankle, mid-calf or knee position, or to fit players in different age groups (i.e., youth and adult). The matched pair of hook and loop material or similar self-attaching materials, are attached at opposite ends of the elastic strap. Attachment of the hook and loop material or similar materials to the elastic strap is achieved by conventional methods of stitching, ultrasonic or heat sealing. The hook and loop materials, or similar materials, can be attached on the surface of the elastic strap or butted against the cut surface of the strap. In either attachment position, the hook and loop materials, or similar materials are facing opposite directions to enable attachment to each other when placed around the leg and used in its intended application.

In use, the soccer player applies his shin guard by either attaching the shin guard to the lower leg and then applying the knit sock over the shin guard, or by inserting the shin guard directly under an already applied sock. Once the shin guard is placed in its comfortable and protective position, the strap of the invention will be applied around the outside of the sock just below and/or just above the shin guard. Using both hands, the device will be wrapped around the leg and the hook and loop material, or similar material, will be attached together to close the device. The player may adjust the fit by simply increasing and/or decreasing the amount of stretch of the elastic strap, thereby increasing or decreasing the amount of force applied against the leg. By attaching the device just below and just above the shin guard, the combination of each elastic strap and the knit sock forms an immovable seal preventing longitudinal movement of the shin guard along the length of the leg, as well as minimizing its lateral movement across the leg. The primary application of the device is to apply it immediately above and immediately below the shin guard. However, an alternative application is to attach the device at a midpoint of the position, approximately at the longitudinal midpoint of the shin guard. This position will not create an immovable seal in combination with the sock, but will provide additional securing force minimizing shin guard movement during play.

DETAILED DESCRIPTION OF THE INVENTION

Figure 1:
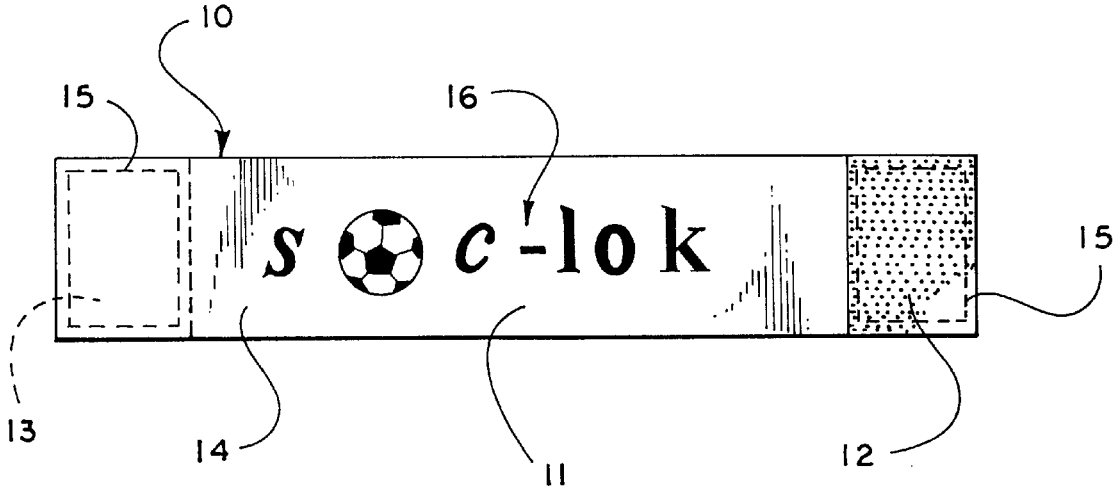
FIG. 1 is a top plan view showing a shin guard strap made in accordance with the present invention.

FIG. 1 shows the invention in detail. The device 10 consists of three primary components including an elongated elastic strap 11, loop material 12 and hook material 13. The loop material 12 and hook material 13 are attached to the outer surface and to the inner surface respectively, at opposite ends of the elastic strap 11 by means of a durable thread 15 using a conventional sewing procedure. For thermoplastic yarns, the loop material 12 and hook material 13 may be attached to the elastic strap 11 using ultrasonic or heat sealing methods (not shown). The elastic strap 11 is made of a suitable surface material 14, such as polyester, to provide a compatible surface for imprinting a permanent design 16. The elastic strap 11 may be cut to different lengths to accommodate its use at different positions on the leg (i.e., preferred ankle and knee positions, alternative midpoint of the position) or for different age groups (i.e., youth and adult).

Figure 2:
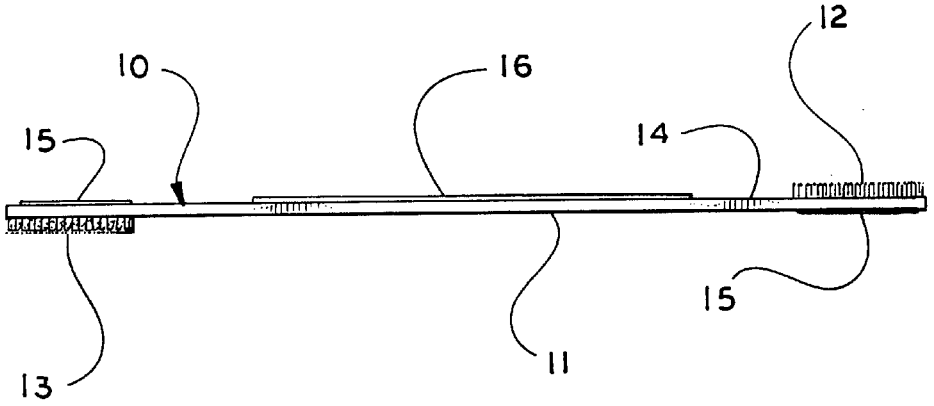
FIG. 2 is a side elevational view showing the shin guard strap illustrated in FIG. 1.

FIG. 2 presents a side elevational view of device 10 showing the loop material 12 and hook material 13 attached at opposite ends and surfaces of elastic strap 11. This arrangement in necessary to attach the matched loop material 12 and hook material 13 to each other when device 10 is applied around the leg. The elastic strap 11 can be made of conventional woven, braided or knitted elastic materials which can be obtained from HNW (Northvale, N.J. 07647) or South Carolina Elastics (Landrum, S.C. 29356). The elastic strap 11 is made of a suitable surface material 14, such as polyester, to provide a compatible surface for imprinting a permanent design 16. The loop material 12 and hook material 13 may be obtained from Velcro® (Manchester, N.H. 03108).

Figure 3:
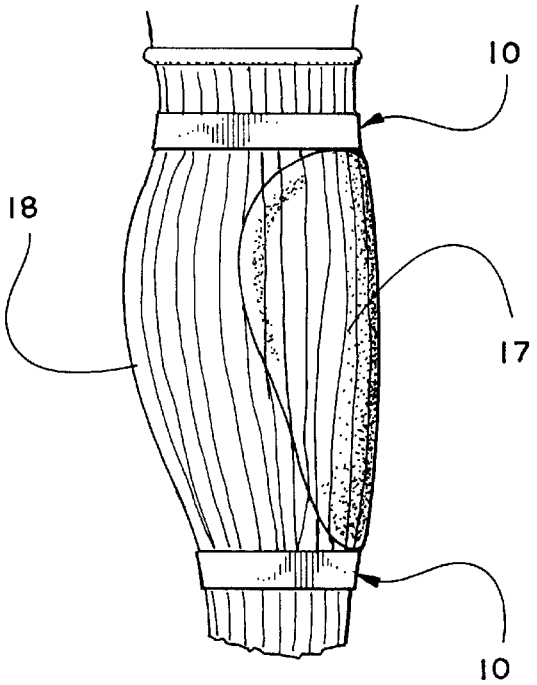
FIG. 3 is a perspective view of the shin guard strap of FIGS. 1 and 2 positioned laterally just above and below the shin guard which in located under a sock or stocking.

FIG. 3 shows how the preferred position of device 10 prevents movement of the shin guard 17 during play. Device 10 acts to compress the sock 18 over the top and/or bottom of the shin guard 17 thereby locking it in its intended protective position. In its sealed position, device 10 prevents the shin guard from moving longitudinally along the length of the leg, and minimizes its lateral movement across the leg.

Figure 4:
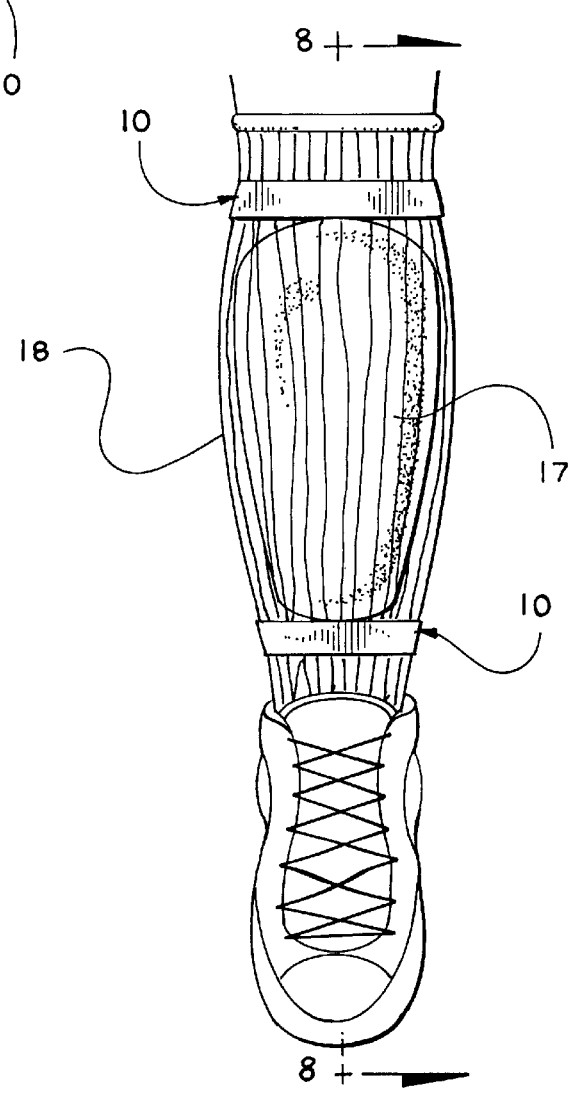
FIG. 4 is a perspective view of a pair of the shin guard straps of FIGS. 1 and 2 demonstrating a first position above the shin guard, and demonstrating a second position below the shin guard which in located under a sock or stocking.

FIG. 4 shows the preferred use of the device 10 as shown in FIGS. 1 and 2. The preferred application of device 10 is to wrap device 10 around the outside of the sock 18, immediately below and above the shin guard 17. For the preferred application, device 10 is worn at the position just below the shin guard 17 to prevent its downward movement towards the ankle during play. Additionally, a second device 10 may also be worn just above the shin guard 17 to prevent its upward movement towards the knee. An alternative position of device 10 would be at midpoint of the, over the midline of the shin guard acting to minimize bidirectional longitudinal movement of the shin guard. For all attachment positions, the device 10 will also minimize side-to-side movement of the shin guard during play.

Figure 5:
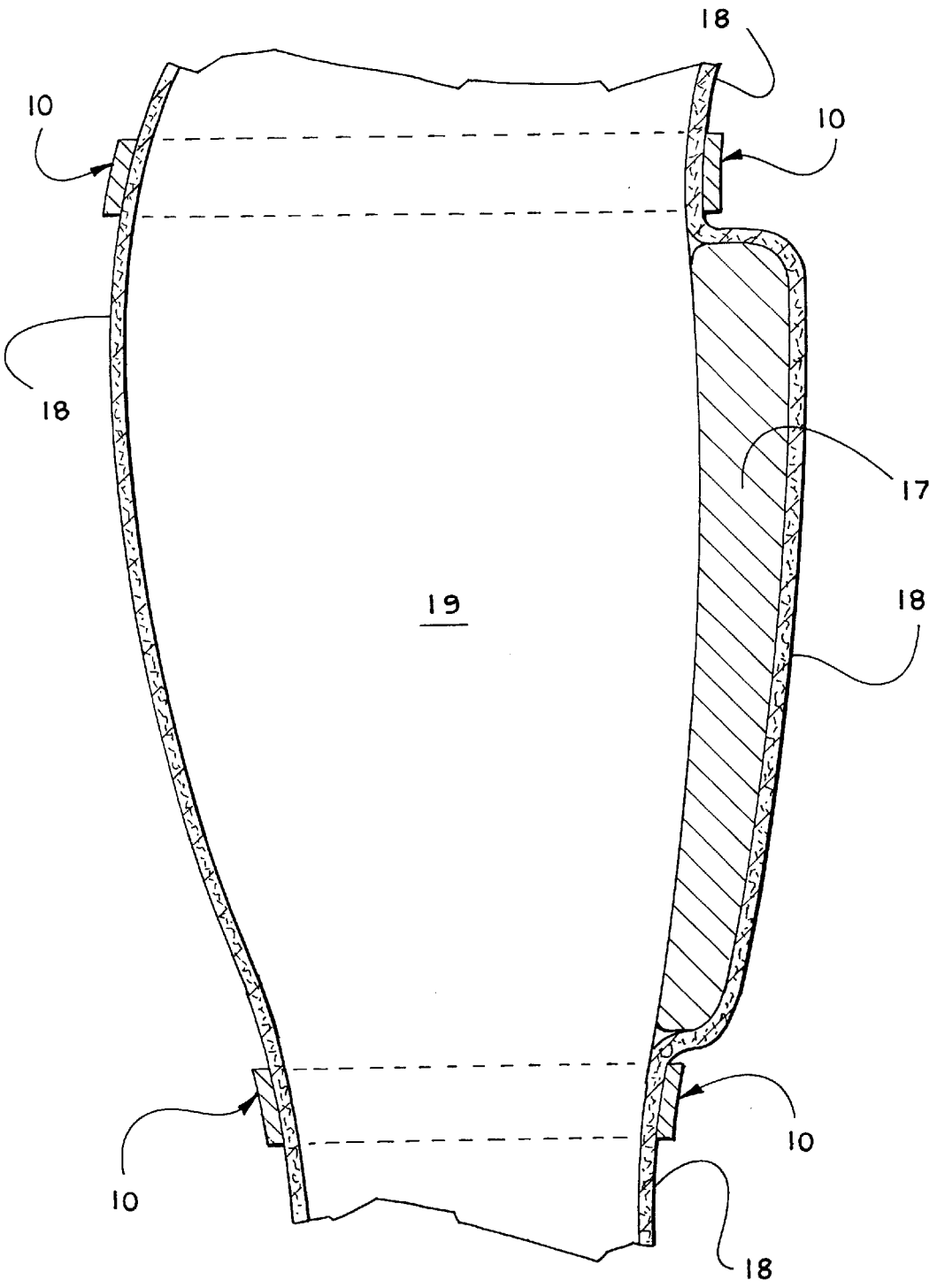
FIG. 5 is partial sectional view taken along lines 8—8 of FIG. 4 demonstrating the means by which the shin guard strap cooperates with the sock to prevent the shin guard from moving up or down the leg.

FIG. 5 shows, in detail, how the device 10 cooperates with the sock 18 to prevent movement of shin guard 17 longitudinally along the length of the leg 19. The elasticity of device 10 compresses the sock over the edge of the shin guard preventing its movement.

I claim:

1. A method of securing a soccer shin guard for limiting motion of the shin guard with respect to a shin, comprising the steps of:

a) inserting a player's lower leg into a sock, the sock having an external surface and an interior surface, the player's lower leg having a shin so that said sock covers the player's shin;

b) disposing a soccer shin guard conjointly between the player's shin and the interior surface of the sock, said soccer shin guard having a lower end adjacent to the player's ankle and an upper end adjacent to the player's knee;

c) encircling the exterior surface of the sock with the player's lower leg therein with a plurality of elastic straps, said straps having an inner surface and an outer surface; and, d) securing one of said straps to itself with attachment means around the exterior surface of the sock immediately adjacent to said lower end of said shin guard, and securing another of said straps to itself with attachment means around the exterior surface of the sock immediately adjacent to said upper end of said shin guard.

2. The method of claim 1 wherein the step of encircling comprises the use of an elastic strap with 80% stretch.

3. The method of claim 1 and further including the step of securing one of said straps to itself around the exterior surface of the sock at the midpoint of the shin guard.

4. The method of claim 1 wherein the step of encircling comprises the use of elastic straps wherein the surfaces of the straps are comprised of material which is compatible with permanent inks and dyes that are water-resistant.

5. The method of claim 1 wherein the step of securing comprises the use of loop material and hook material affixed respectively to the inner surface and the outer surface of the strap whereby the strap attaches to itself.

6. The method of claim 1 wherein the step of securing comprises the use of a matched pair of snaps whereby the strap attaches to itself.

7. In the combination of a shin guard placed over a player's shin, a sock covering the player's leg and shin and said shin guard, said shin guard having a lower end and an upper end, and means for holding said shin guard in place with respect to the player's shin, the improvement comprising a first elastic shin guard strap extending completely around said sock with the player's leg therein, said first elastic shin guard strap being located immediately adjacent to said lower end of said shin guard and being tight enough to prevent downward movement of said shin guard, and a second elastic shin guard strap extending completely around said sock with the player's leg therein, said second elastic shin guard strap being located immediately adjacent to said upper end of said shin guard and being tight enough to prevent upward movement of said shin guard.

8. The combination as claimed in claim 7, and further including a third elastic shin guard strap extending completely around said sock with the player's leg therein, said third elastic shin guard strap being located mid way between said upper end and said lower end, and being tight enough to limit lateral motion of said shin guard.

* * * * *